US010106869B2

(12) United States Patent
Weber

(10) Patent No.: US 10,106,869 B2
(45) Date of Patent: Oct. 23, 2018

(54) PLATINUM BASED ALLOYS

(75) Inventor: Ludger Weber, Le Mont-sur-Lausanne (CH)

(73) Assignee: Ecole Polytechnique Federale de Lausanne (EPFL), Lausanne (CH)

( * ) Notice: Subject to any disclaimer, the term of this patent is extended or adjusted under 35 U.S.C. 154(b) by 456 days.

(21) Appl. No.: 14/115,428

(22) PCT Filed: May 2, 2012

(86) PCT No.: PCT/IB2012/052197

§ 371 (c)(1),
(2), (4) Date: Nov. 14, 2013

(87) PCT Pub. No.: WO2012/150558

PCT Pub. Date: Nov. 8, 2012

(65) Prior Publication Data

US 2014/0096874 A1 Apr. 10, 2014

(30) Foreign Application Priority Data

May 2, 2011 (WO) ..... PCT/IB2011/051927

(51) Int. Cl.
*C22C 45/10* (2006.01)
*C22C 5/04* (2006.01)
(Continued)

(52) U.S. Cl.
CPC ..... *C22C 5/04* (2013.01); *C22C 1/002* (2013.01); *C22C 1/02* (2013.01); *C22C 45/003* (2013.01)

(58) Field of Classification Search
CPC ..... C22C 5/04; C22C 1/02; C22C 1/002
See application file for complete search history.

(56) References Cited

U.S. PATENT DOCUMENTS 4,560,454 A * 12/1985 Harris et al. ..... 205/474
4,781,803 A 11/1988 Harris et al.
(Continued)

FOREIGN PATENT DOCUMENTS

EP 0 621 349 A1 10/1994
JP 63-47533 B2 9/1888
(Continued)

OTHER PUBLICATIONS

International Search Report for PCT/IB2012/052197, dated Sep. 6, 2012.
(Continued)

*Primary Examiner* — Haytham Soliman
(74) *Attorney, Agent, or Firm* — Nixon & Vanderhye P.C.

(57) ABSTRACT

An article made of an alloy of the general formula $Pt_{1-a-b}M_a(B_{1-x}Md_x)_b$ in which i) M stands for one or a mixture of metallic element(s) of the group Zr, Ti, Fe, Ni, Co, Cu, Pd, Ag, Al; ii) Md stands for one or a mixture of several metalloids of the group Si, P, C, S, As, Ge; iii) a is smaller than 0.2; iv) b is comprised between 0.2 and 0.5; v) x is comprised between 0 and 0.8; vi) the overall P content, if present, is less than 10 atomic percent the proportions of the elements forming the alloy having been selected to confer a hardness of at least 400 HV, a melting point below 1000° C. and improved processibility to the alloy.

17 Claims, 1 Drawing Sheet

(51) Int. Cl.

| | |
|---|---|
| ***C22C 1/00*** | (2006.01) |
| ***C22C 1/02*** | (2006.01) |
| ***C22C 45/00*** | (2006.01) |

(56) References Cited

U.S. PATENT DOCUMENTS

| | | | |
|---|---|---|---|
| 5,518,556 | A | 5/1996 | Weber et al. |
| 2006/0124209 | A1 | 6/2006 | Schroers et al. |

FOREIGN PATENT DOCUMENTS

| | | | |
|---|---|---|---|
| JP | 56-3642 | A | 1/1981 |
| JP | S563642 | A | 4/1981 |
| JP | S5681646 | A | 7/1981 |
| JP | 62-130238 | A | 6/1987 |
| JP | 2003-47512 | A | 2/2003 |
| JP | 2003047512 | A | 2/2003 |
| JP | 200790157 | A | 4/2007 |
| JP | 2007090157 | A | 4/2007 |
| WO | 00/32829 | A1 | 6/2000 |
| WO | 2006/066215 | A2 | 6/2006 |

OTHER PUBLICATIONS

Written Opinion of the International Searching Authority for PCT/IB2012/052197, dated Sep. 6, 2012.

Chaston, J.C., "The Purity of Platinum", http://www.platinummetalsreview.com/pdf/pmr-v15-14-122-128.pdf, (Apr. 1, 1971), pp. 122-128.

Notice of Reasons for Rejection dated Jan. 12, 2016, issued in Japanese Patent Application No. 2014-508910 and English translation.

Ainsley, G., et al., "Platinum Investment Casting Alloys, New Materials with Improved Properties and Casting Characteristics," Platinum Metals Rev., 1978, vol. 22, No. 3, pp. 78-87.

Biggs, T., et al., "The Hardening of Platinum Alloys for Potential Jewellery Application," Platinum Metals Rev., 2005, vol. 49, No. 1, pp. 2-15.

Demetriou, Marios D., et al., "Liquid-like platinum-rich glasses," Scripta Materialia, vol. 65, 2011, pp. 799-802.

Schroers, Jan, et al., "Precious bulk metallic glasses for jewelry applications," Materials Science and Engineering A, vols. 449-451, 2007, pp. 235-238.

The First Office Action dated Apr. 3, 2015, issued in Chinese Patent Application No. 201280021634.4, and English translation.

The Second Office Action dated Feb. 4, 2016, issued in Chinese Patent Application No. 201280021634.4, and English translation.

The Third Office Action dated Jun. 23, 2016, issued in Chinese Patent Application No. 201280021634.4, and English translation.

Decision of Rejection dated Nov. 1, 2016, issued in Japanese Patent Application No. 2014-508910, and English translation.

Gurešić, Dejan, et al., "Effects of the Chemical Composition on the Microstructure and Properties of the Cu—Ge—Sb Alloys," Journal of Engineering & Processing Management, vol. 8, No. 1, 2016, pp. 45-64.

Inoue, Akihisa, "Stabilization of Metallic Supercooled Liquid and Bulk Amorphous Alloys," Acta Materialia, vol. 48, 2000, pp. 279-306.

Kazemi, Hamed, "Alloy Development of a New Platinum-Based Bulk Metallic Glass," Thesis No. 7517, École Polytechnique Fédérale de Lausanne, 2017, 209 pages.

Kazemi, Hamed, et al., "Development of a new family of phosphorous-free Pt-based bulk metallic glasses," Journal of Alloys and Compounds, vol. 695, 2017, pp. 3419-3428.

Srivastava, P. K., et al., "A Noncrystalline Pt—Sb Phase and Its Equilibration Kinetics," Metallurgical Transactions, vol. 3, Apr. 1972, pp. 977-982.

* cited by examiner

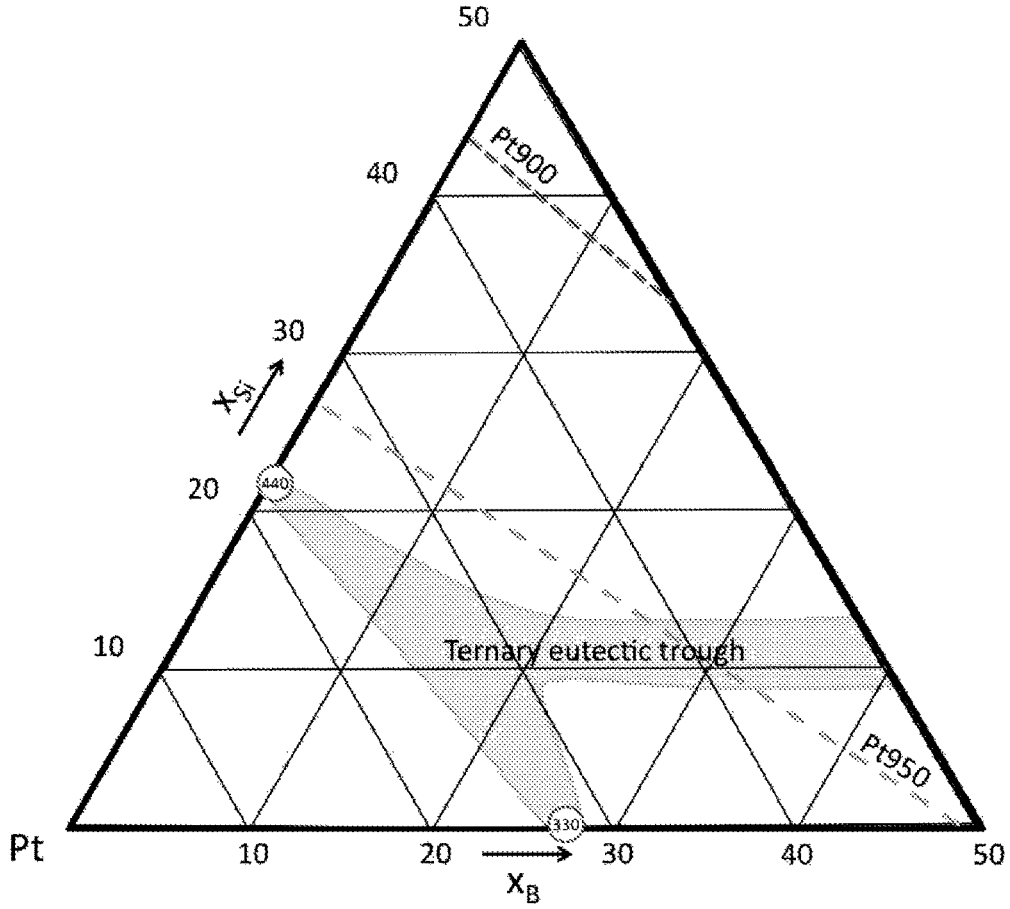
50
40
30
20
10
Pt
10
20
30
40
50
$X_{Si}$
$X_B$
Pt900
Pt950
440
330
Ternary eutectic trough

PLATINUM BASED ALLOYS

This application is the U.S. national phase of International Application No. PCT/IB2012/052197, filed 2 May 2012, which designated the U.S. and claims priority to International Application No. PCT/IB2011/051927, filed 2 May 2011, the entire contents of each of which are hereby incorporated by reference.

FIELD OF THE INVENTION

The present invention relates to platinum based alloys which may be used in different fields, for instance in jewellery or watch making.

BACKGROUND OF THE INVENTION

The relatively low hardness of platinum and gold alloys is a major limitation in their use in jewellery and watch making, essentially due to their proneness to wear and scratching which degrades the visual appeal of items made thereof.

A second difficulty associated with objects made of platinum by casting is the inherently high melting point of the currently used platinum alloys. This entails low volume casting trees and special refractory materials for mould making. Significantly reducing the melting temperature of platinum alloys for use in jewellery and watch making would be therefore of interest.

Typical gold and platinum alloys have a hardness below 300 HV and 200 HV, respectively. Some less standard grades of hardenable Pt-alloys mainly with Zr, Ti and Ga as alloying elements reach hardness up to 421 HV [1].

Described in the literature are the binary eutectic alloys of Pt—Si and Pt—B with typically 2-5 wt % of alloying additions having a hardness of 440 HV and 327 HV, respectively [2].

Known to the state of the art are further bulk metallic glasses based on Pt with a hardness "around 400 HV" [3, 4]. These alloys are essentially quartenary or higher order alloys derived from the Pt—P system with additional alloying elements to maintain the glassy state in the alloy at low cooling rates and concomitantly to larger cross sections [5]. Due to these alloying elements the overall Pt content is typically close to 850/1000 and thus below the level of generally accepted jewellery grade Pt which is 950/1000 in Europe and 900/1000 in the US. In an effort to comply with the 950/1000 standard (see Ref [3]), an alloy has recently been described in the literature where a small fraction of the main alloying element phosphorus is replaced by 4 and 1.5 at.-pct of B and Si, respectively, yielding a hardness of 395 HV [6].

Japanese patent application JP 1985/0268628 [7] furthermore discloses a high hardness Pt alloy containing 1.5-6.5 wt.-pct Si and several wt.-pct of alloying elements of the group Pd, Cu, Ir, Rh, Au, Ag, Ni, and Co. The hardness is up to 580, 620 and 630 HV for alloys complying with the Pt 950/1000, 900/1000 and 850/1000 standard, respectively. Analysing the data from this prior art shows that:

i) The hardness is first depending on the silicon content increasing strongly up to about 4 wt.-pct Si, corresponding to the binary eutectic ii) For a given Si content increasing the content of a ternary alloying element, e.g. Cu from 7 to 12 wt.-pct, has only little effect on the hardness.

iii) The addition of as little as 1 wt.-pct of Cu to the eutectic composition changes the hardness from 440 HV [2] to 580 HV.

Known are furthermore surface treatments of Pt and their alloys by creation of a diffusion layer in which the alloys are hardened by letting Ga and B diffuse into the Pt base metal [8, 9]. Surface hardness values of up to 385 HV and 700 HV for Ga and B, respectively have been disclosed [8]. In the case of the B diffusion layer the hardness is explicitly mentioned to be derived from including the B as interstitial solid solution in the Pt crystals. However, the cited concentrations of B in Pt are difficult to conciliate with Pt—B solid solution as claimed to be the reason for the high hardness in that patent [9].

GENERAL DESCRIPTION OF THE INVENTION

The present invention relates to scratch resistant platinum base alloys, as defined in the claims, for use in e.g. watch making or jewellery. The alloys according to the invention are at least composed of three different elements, including at least platinum, which is the main one, and boron.

The alloys according to the invention preferably show a high hardness, typically above 400, and more preferably above 600 HV, to make them scratch resistant. They furthermore advantageously show a relatively low melting point, typically below 1000° C., for ease of production by casting.

In a preferred embodiment the invention relates to alloys of composition $Pt_{1-a-b}M_a(B_{1-x}Md_x)_b$ in which a is zero, b is comprised between 0.2 and 0.45 and x is comprised between 0.1 and 0.8 and the platinum content is at least 85 pct by weight. Such ternary alloys are characterized by a low melting point below 850° C. and high hardness exceeding 450 HV.

A particular feature of the alloys according to the invention is that they exhibit hardness that is significantly higher (+100 to 400 HV) then what would be expected from a rule of mixture of the binary eutectics of Pt—B and Pt—Si, i.e. comprised between 327 and 440 HV. As an example an alloy of the composition $Pt_{0.61}B_{0.28}Si_{0.11}$ exhibits a hardness in excess of at least 650 HV.

Of particular interest are alloys in the vicinity of the eutectic trough, cf. FIG. 1, in the ternary system Pt—B—Si, since they exhibit low melting point, fine microstructure and high hardness. By way of example the melting point of an alloy with the composition $Pt_{0.73}B_{0.16}Si_{0.12}$ exhibits a melting point of around 700° C. while an alloy of $Pt_{0.61}B_{0.28}Si_{0.11}$ had a melting point of around 760° C., this being to be compared to the binary eutectic melting points of 790° C. and 847° C. for the Pt—B and Pt—Si system, respectively. Substituting 3 at.-pct of Pt by elements of the group Ni, Co, Fe, Cu, Ge of the alloy with the basic composition $Pt_{0.73}B_{0.16}Si_{0.12}$would lower the melting point in the range of 660 to 700° C. as measured by DSC.

With the present invention already small amounts of substitution of Pt in the ternary alloys previously defined by alloying elements of the group Zr, Ti, Fe, Co, Ni, Cu, Pd, Ag induce an additional increase in hardness of 50-100 HV.

Those relatively low melting points render some of the alloys according to invention interesting for being processed by passing through an amorphous state which confers to the alloy increased ductility during processing in an intermediate temperature range. The final increased hardness of the alloy will be obtained by a subsequent heat treatment step following the deformation step in the amorphous state.

One original feature of an embodiment of the present invention with respect to the prior art consists in using Si and B as major alloying elements simultaneously and keeping the phosphorous content well below 10 at-pct. With respect to the prior art, the alloys according to the present invention use boron, and in most cases boron and silicon as a main alloying elements, which increases the hardness considerably compared to the alloys using only Si (or only boron) as a metalloid alloying element.

BRIEF DESCRIPTION OF THE FIGURE

FIG. 1 represents a ternary eutectic trough in the Pt—B—Si system. Indicated are also the hardness values for the binary eutectic compositions (in HV) and the compositions corresponding to the Pt950 and the Pt900 standard, respectively.

DETAILED DESCRIPTION OF THE INVENTION

The present invention will be better understood below by way of non-limiting examples relating to Platinum base alloys exhibiting a high hardness, i.e. in excess of at least 450 HV.

These alloys are based on the binary Pt—B system with at least one more metallic alloying element or on the Pt—B—Si ternary system. While alloys solely based on the Pt—B—Si ternary may suffice to obtain hardness in excess of 650 HV one or several additional alloying elements may be introduced to further increase hardness or improve processibility.

The alloys disclosed in this invention may be described by the general formula (subscripts refer to atomic fractions)

$$Pt_{1-a-b}M_a(B_{1-x}Md_x)_b$$

in which i) M stands for one or a mixture of metallic element(s) of the group Al, Ti, Fe, Ni, Co, Cu, Zr, Pd, Ag
ii) Md stands for a metalloid of the group Si, P, C, S, As, Ge
iii) a is smaller than 0.2
iv) b is comprised between 0.2 and 0.55
v) x is comprised between 0 and 0.8
vi) the overall P content, if present, is less than 10 atomic percent The specific composition is chosen in the limits of the parameters given above to obtain an alloy with a minimum Pt content of 850/1000 by weight, preferably 900/1000 by weight or even more preferably 950/1000 by weight.

Alloys according to this definition exhibit a low melting point, i.e. below 1000° C., preferably below 800° C. and even more preferably below 700° C.

Alloys of particular interest in the context of this invention are those located close to the regions of lowest melting point indicated as a light grey area in FIG. 1. While for ternary systems intersections of liquidus surfaces associated with stable solids are given by well defined lines, additional alloying elements may shift these lines both in the composition range in the ternary alloy as well as in terms of the temperature, justifying the indication of a low melting point area in FIG. 1 rather than neat lines.

Nevertheless, if high hardness is of prime importance, alloys outside this ternary eutectic trough, yet in accordance with the general formula given above may be chosen, cf. Example 9 below.

The preparation of the alloy is preferably achieved by melting under protective atmosphere by arc melting or melting in a quartz crucible by induction heating, resistance heating or heating by a torch flame.

For alloys that are cast into parts and are obtained in crystallized form, vacuum melting and casting in a copper mould is the preferred processing route. Alternatively, melting can be done under protective atmosphere and casting in investment moulds.

Alloy compositions leading to a melting point below 800° C. preferably below 750° C. may be particularly desirable. The low melting point confers to the alloy two desirable properties: On the one hand some of the difficulties associated with casting of platinum alloys, e.g. the high heat input in the refractory mould material and shrinkage upon cooling down, can be considerably reduced as the alloys concerned by this disclosure have melting characteristics comparable to gold alloys that are known to be much better castable. On the other hand, due to the low melting point and the rather complex unit cells in the boron and silicon containing phases forming in thermodynamic equilibrium as well as the alloying elements employed for rendering crystallization more difficult, the alloys described above may be obtained in an amorphous state depending on the cooling conditions after melting. Processes to obtain this amorphous state include, yet are not limited to, splat quenching, melt spinning, melt atomization, and copper mould quenching. The amorphous state may also be obtained by re-melting and solidifying when submerged in de-hydrated $B_2O_3$ flux. This step may be crucial for cases where the preliminary melting procedure did not effectively eliminate or prevent the creation of heterogeneous nucleation sites for crystallization.

Semi finished products or feedstock in wire or powder form may be easily deformable in their super-cooled liquid region (SCLR), i.e. a temperature range between their glass transition temperature and their crystallization temperature. Thus, even complex shaped items may be formed from amorphous feedstock. Given the high hardness of the boron and or silicon containing phases in the Pt—Si—B system, a heat treatment subsequent to the viscous shaping process may substantially increase their hardness at the price of reduced fracture toughness and ductility.

As an example (example A) of a way to produce an amorphous Pt-based alloy, an alloy with the composition $Pt_{0.48}Ni_{0.16}(B_{0.75}Si_{0.25})_{0.36}$ was melted under purged argon atmosphere in a quartz tube heated by a torch flame. As such the present alloy contained more than 850/1000 by weight of platinum. After solidification the ingot was transferred in another quartz tube with an orifice of 0.8 mm inserted in a melt spinner. After heating under vacuum by induction a helium pressure of 100 mbars was applied over the melt projecting the melt onto a rotating copper wheel, a process known as melt spinning The obtained ribbon was 2 to 3 mm wide and approximately 25 μm thick and had an even and shiny surface. A DSC run under high purity argon at a heating rate of 10 K/min revealed in the first heating cycle an slightly endothermic bump with onset at roughly 550 K followed by an exothermic peak at roughly 590 K. Another endothermic peak was observed at roughly 970 K. Subsequent cooling from 1200 K exhibited an exothermic peak at 945 K. No further peak was observed below this temperature. The onset of the first bump is interpreted as the glass transition temperature while the second peak is considered to be due to crystallization.

An XRD scan of the ribbon yielded a single broad peak characteristic for an amorphous state. Microhardness on the ribbon was measured with a load of 10 g due to the limited width of the ribbon yielding values around 500 HV. In its crystallized state after DSC the alloy had coagulated to a sphere and exhibited a hardness in excess of 700 HV.

As second example (example B) of a way to produce an amorphous Pt-based alloy, an alloy with the composition $Pt_{0.695}Ni_{0.035}(B_{0.55}Si_{0.44})_{0.27}$ was melted under purged argon atmosphere in a quartz tube heated by a torch flame. As such the present alloy contained more than 950/1000 by weight of platinum. After solidification the ingot was transferred in another quartz tube with an orifice of 0.8 mm inserted in a melt spinner. After heating under vacuum by induction a helium pressure of 100 mbars was applied over the melt projecting the melt onto a rotating copper wheel, a process known as melt spinning The obtained ribbon was 2 to 3 mm wide and approximately 20-40 μm thick and exhibited a shiny yet slightly uneven surface. A DSC run under high purity argon at a heating rate of 10 K/min revealed in the first heating cycle a slightly endothermic bump with onset at roughly 520 K followed by an exothermic peak at roughly 550 K. Another endothermic peak was observed at roughly 950 K. Subsequent cooling from 1200 K exhibited an exothermic peak at 945 K. No further peak was observed below this temperature. The onset of the first bump is interpreted as the glass transition temperature while the second peak is considered to be due to crystallization.

Based on the values of glass transition, crystallization, and melting temperature the parameters of glass forming ability (GFA) of these alloys can be evaluated. A number of currently used GFA parameters are given in Table 1 together with their range characteristic for good bulk metallic glass formability.

TABLE 1

Various parameters characterizing the GFA and the glass stability of BMGs and their appropriate ranges compared to the values of examples A and B.

| Parameter | Definition | Example A | Example B | Good GFA range | High glass stability |
|---|---|---|---|---|---|
| $T_{rg}$ | $T_{rg} = T_g/T_1$ | 0.58 | 0.55 | $T_{rg} \geq 0.6$ | |
| $\gamma$ | $\gamma = T_x/(T_g + T_1)$ | 0.38 | 0.37 | $\gamma \geq 0.4$ | |
| $\Delta T$ | $\Delta T = T_x - T_g$ | 40 | 30 | | $\Delta T \geq 50K$ |

As can be seen, the current parameters are all gathered at the lower end of good GFA and glass stability and will thus confer a relatively low critical casting thickness (<2 mm) to the alloy in the example given. This however does not mean that this is a limitation applying to all the alloys described in this disclosure.

Influence of Alloying Elements

Several alloying elements may be added to the base alloys near the eutectic trough. Ni, Co, Cu, and Fe are essentially interchangeable and are used to substitute a small fraction of Pt. They act in essence to i) reduce the melting temperature of the ternary Pt—B—Si alloy ii) increase the hardness of the resulting alloy These alloys may furthermore have a weak influence on the glass transition temperature and the crystallization temperature.

Alloying elements of the group Al, Ti, Zr, and Ag are in small quantities, i.e. below 3 at.-pct, helpful for rendering the crystallisation of the thermodynamically stable phases more difficult and thus may contribute to a increased ease of obtaining the amorphous state. At higher concentrations an increasing tendency to form stable silicides and borides particularly of Zr and Ti may hamper the formation of the amorphous state.

Pd may be used as a substitute for Pt with the effect of essentially increasing the disorder in the alloy according to the "confusion principle" often employed in making of amorphous metals.

Alloying elements of the group C, P, Ge, S, and As may be used as partial substitutes of the main metalloid components B and Si. Ge has been found to increase the hardness of the resulting alloys. Small amounts of P will essentially reduce the melting temperature and the glass transition temperature and may slightly reduce the hardness both of the glassy state and the crystallized state.

EXAMPLES

Example 1

An alloy of 4.756 g of Pt, 0.123 g of Si and 0.121 g of boron is melted in an electric arc under Ar protective atmosphere. The overall Pt content is higher than 950/1000. The resulting metallic droplet has a metallic luster and is hot-mounted and then cut by a diamond wheel. The polished surface exhibits a very fine two-phase structure appearing homogeneous under low magnification. The microhardness is measured with a Gnehm Microhardness tester at a load of 1 kg. The indicated hardness is 670 HV.

Example 2

An alloy of 3.918 g of Pt, 0.117 g of Si and 0.079 g of boron is melted in an electric arc under Ar protective atmosphere. The overall Pt content is higher than 950/1000. The resulting metallic droplet has a metallic luster and is hot-mounted and then cut by a diamond wheel. The polished surface exhibits a very fine two-phase structure with a very small amount of slight grey primary phase. The microhardness of the matrix is measured with a Gnehm Microhardness tester at a load of 1 kg. The indicated hardness is 630 HV on average.

Example 3

An alloy of 19.009 g of Pt, 0.654 g of Si and 0.337 g of boron is melted in an electric arc under Ar protective atmosphere. The overall Pt content is higher than 950/1000. The resulting metallic droplet has a metallic luster and is hot-mounted and then cut by a diamond wheel. The polished surface exhibits a very fine two-phase structure appearing homogeneous under low magnification. The microhardness is measured with a Gnehm Microhardness tester at a load of 1 kg. The indicated hardness is 660 HV on average.

Example 4

An alloy of 5.515 g of Pt, 0.114 g of boron, and 0.164 g of Cu is melted in an electric arc under Ar protective atmosphere. The overall Pt content is higher than 950/1000. The resulting metallic droplet has a metallic luster and is hot-mounted and then cut by a diamond wheel. The polished surface exhibits a very fine two-phase structure appearing homogeneous under low magnification. The microhardness is measured with a Gnehm Microhardness tester at a load of 1 kg. The indicated hardness is 680 HV on average.

Example 5

An alloy of 4.507 g of Pt, 0.344 g of Si and 0.149 g of boron is melted in an electric arc under Ar protective atmosphere. The overall Pt content is higher than 900/1000. The resulting metallic droplet has a metallic luster and is hot-mounted and then cut by a diamond wheel. The polished surface exhibits a very fine two-phase structure with roughly 20 vol % of a dark gray primary phase of a few tens of μm in size. The microhardness of the matrix is measured with a Gnehm Microhardness tester at a load of 1 kg. The indicated hardness is 690 HV on average. The microhardness of the dark gray primary phase is in excess of 3000 HV. Macrohardness of the two-phase structure is measured on a Gnehm Hardness tester with a load of 62.5 kg. The hardness deduced from the indentation is 720 HV.

Example 6

An alloy of 4.518 g of Pt, 0.265 g of Si, and 0.216 g of boron, is melted in an electric arc under Ar protective atmosphere. The overall Pt content is higher than 900/1000. The resulting metallic droplet has a metallic luster and is hot-mounted and then cut by a diamond wheel. The polished surface exhibits a very fine multiphase structure in the matrix with roughly 30 vol % of a facetted dark gray primary phase of a few tens of μm in size. The microhardness of the matrix is measured with a Gnehm Microhardness tester at a load of 1 kg. The indicated hardness is around in the range between 650 and 780 HV with a value of 725 HV on average.

Example 7

An alloy of 4.605 g of Pt, 0.162 g of Si, 0.112 g of boron, and 0.120 g of Ge is melted in an electric arc under Ar protective atmosphere. The overall Pt content is higher than 900/1000. The resulting metallic droplet has a metallic luster and is hot-mounted and then cut by a diamond wheel. The polished surface exhibits a very fine two-phase structure in the matrix with roughly 30 vol % of a dark gray primary phase of a few tens of μm in size. The microhardness of the matrix is measured with a Gnehm Microhardness tester at a load of 1 kg. The indicated hardness is around 700 HV on average. The microhardness of the dark gray primary phase is in excess of 3000 HV.

Example 8

An alloy of 2.742 g of Pt, 0.187 g of Si, 0.026 g of boron, and 0.045 g of Cu is melted in a fused silica tube under Ar protective atmosphere by a torch flame. The overall Pt content is higher than 900/1000. The resulting metallic droplet has a metallic luster and is hot-mounted and then cut by a diamond wheel. The polished surface exhibits a very fine three-phase structure appearing homogeneous under low magnification. The microhardness of the alloy is measured with a Gnehm Microhardness tester at a load of 1 kg. The indicated hardness ranges between 720 and 800 HV.

Example 9

An alloy of 4.516 g of Pt, 0.280 g of Si, 0.045 g of boron, 0.084 g of Ge and 0.075 g of Cu is melted in a fused silica tube under Ar protective atmosphere by a torch flame. The overall Pt content is higher than 900/1000. The resulting metallic droplet has a metallic luster and is hot-mounted and then cut by a diamond wheel. The polished surface exhibits a very fine three-phase structure appearing homogeneous under low magnification. The microhardness of the alloy is measured with a Gnehm Microhardness tester at a load of 1 kg. The indicated hardness ranges between 650 and 890 HV.

Example 10

An alloy of 2.710 g of Pt, 0.167 g of Si, 0.027 g of boron, 0.026 g of Ge, 0.045 g of Cu, and 0.025 g Ag is melted in a fused silica tube under Ar protective atmosphere by a torch flame. The overall Pt content is higher than 900/1000. The resulting metallic droplet has a metallic luster and is hot-mounted and then cut by a diamond wheel. The polished surface exhibits a very fine three-phase structure appearing homogeneous under low magnification. The microhardness of the alloy is measured with a Gnehm Microhardness tester at a load of 1 kg. The indicated hardness ranges between 680 and 720 HV.

The invention is of course not limited to the alloys disclosed in the examples discussed above.

REFERENCES

1. Biggs, T., S. S. Taylor, and E. van der Lingen, *The hardening of platinum alloys for potential jewellery application*. Platinum Metals Review, 2005. 49(1): p. 2-15.

2. Ainsley, G., A. A. Bourne, and R. W. E. Rushforth, *Platinum investment casting alloys*. Platinum Metals Review, 1978. 22(3): p. 78-87.

3. Schroers, J. and W. L. Johnson, *Pt-base bulk solidifying amorphous alloys*. 2006: US patent application 2006/0124209, pp. 18.

4. Schroers, J., et al., *Precious bulk metallic glasses for jewelry applications*.

Materials Science and Engineering A-Structural Materials Properties Microstructure and Processing, 2007. 449: p. 235-238.

5. Johnson, W. and J. Schroers, *Bulk-solidifting amorphous alloy for jewelry applications, comprises at least four elemental components having specified Poisson's ratio, elastic strain limit, ductility, bend ductility and fracture toughness*. 2006, PCT patent application WO 2006/066215, pp. 49.

6. Demetriou, M. D., et al., *Liquid-like platinum-rich glasses*. Scripta Materialia, 2011. 65(9): p. 799-802.

7. Yuichiro, Y., *Hard platinum alloy for ornamentation*. 1987: Japanese patent application JP 1985/0268628 pp. 3.

8. Kretchmer, S., *Heat treated platinum alloy for jewellery making—contains platinum, gallium and palladium*. WO 00/32829, pp. 21.

9. Weber, W., K. Zimmermann, and H. Beyer, *Objects made of platinum and palladium—comprise hard scratch-resistant surface layer contg. boron in the metal lattice*. European patent application EP 1993/0120771 pp. 4.

The invention claimed is:

1. A metallic glass made of an alloy of the formula $Pt_{1-a-b-c}M_aA_c(B_{1-x}Md_x)_b$ wherein M stands for one or a mixture of metallic elements of the group Cu and Ni, A stands for one or a mixture of alloying metallic elements Al, Ti, Zr, and Ag, Md stands for one or a mixture of metalloids of the group Si, P, C, S, As, Ge, and wherein Md includes Si, a is greater than 0 and smaller than 0.2, b is between 0.2 and 0.55, c is smaller than 0.03, x is between 0.1 and 0.8, the overall P content, if present, is less than 10 atomic percent, and wherein the alloy has a hardness of at least 700 HV when in a crystalline state, a melting point below 1000° C., and is capable of being shaped in a super cooled liquid region (SCLR).

2. The metallic glass according to claim 1 wherein Md stands for one or a mixture of several metalloids of the group Si, C, S, As, Ge, and Md includes Si.

3. The metallic glass according to claim 1 wherein the alloy has the composition $Pt_{0.48}Ni_{0.16}(B_{0.75}Si_{0.25})_{0.36}$.

4. The metallic glass according to claim 1 wherein the alloy has the composition $Pt_{0.695}Ni_{0.035}(B_{0.55}Si_{0.44})_{0.27}$.

5. The metallic glass according to claim 1 having an overall Pt-content of at least 850/1000 by weight.

6. The metallic glass according to claim 5 having an overall Pt-content of at least 900/1000 by weight.

7. The metallic glass according to claim 6 having an overall Pt-content of at least 950/1000 by weight.

8. A metallic glass made of an alloy of the formula $Pt_{1-a-b}Ni_a(B_{1-x}Si_x)_b$ wherein a is greater than 0 and smaller than 0.2, b is between 0.2 and 0.55, and x is greater than 0 and less than 0.8, wherein the alloy has a hardness of at least 700 HV when in a crystalline state, and is capable of being shaped in a super cooled liquid region (SCLR).

9. The metallic glass according to claim 8 having an overall Pt-content of at least 850/1000 by weight.

10. The metallic glass according to claim 8 having an overall Pt-content of at least 900/1000 by weight.

11. The metallic glass according to claim 8 having an overall Pt-content of at least 950/1000 by weight.

12. A jewelry or watch article including a part made of a metallic glass according to claim 1.

13. A jewelry or watch article including a part made of a metallic glass according to claim 8.

14. A metallic glass made of an alloy of the formula $Pt_{1-a-b-c}Cu_aA_c(B_{1-x}Md_x)_b$ wherein A stands for one or a mixture of alloying metallic elements Al, Ti, Zr, and Ag, Md stands for one or a mixture of metalloids of the group Si, P, C, S, As, Ge, and wherein Md includes Si, a is greater than 0 and smaller than 0.2, b is between 0.2 and 0.55, c is smaller than 0.03, x is between 0.1 and 0.8, the overall P content, if present, is less than 10 atomic percent, and wherein the alloy has a hardness of at least 700 HV when in a crystalline state, a melting point below 1000° C., and is capable of being shaped in a super cooled liquid region (SCLR).

15. The metallic glass according to claim 14, wherein Md stands for the one or a mixture of several metalloids of the group Si, C, S, As, Ge, and Md includes Si.

16. A jewelry or watch article including a part made of a metallic glass according to claim 14.

17. A metallic glass made of an alloy of the formula $Pt_{1-a-b-c}M_aA_c(B_{1-x}Md_x)_b$ wherein M stands for one or a mixture of metallic elements of the group Cu, Fe, Co and Ni, A stands for one or a mixture of alloying metallic elements Al, Ti, Zr, and Ag, Md stands for one or a mixture of metalloids of the group Si, P, C, S, As, Ge, and wherein Md includes Si, a is greater than 0 and smaller than 0.2, b is between 0.2 and 0.55, c is smaller than 0.03, x is between 0.1 and 0.8, the overall P content, if present, is less than 10 atomic percent, and wherein the alloy has a hardness of at least 700 HV when in a crystalline state, a melting point below 1000° C., and is capable of being shaped in a super cooled liquid region (SCLR).

* * * * *